United States Patent [19]

Bakhit

[11] Patent Number: 4,826,231

[45] Date of Patent: May 2, 1989

[54] HELMET CARRIER

[76] Inventor: Abraham Bakhit, 3818 Burt, Omaha, Nebr. 68131

[21] Appl. No.: 198,069

[22] Filed: May 24, 1988

[51] Int. Cl.[4] ..... B65D 71/00

[52] U.S. Cl. ..... 294/158; 294/1.1; 294/15; 294/161

[58] Field of Search ..... 294/158, 161, 137, 1.1, 294/15; 2/425

[56] References Cited

U.S. PATENT DOCUMENTS 3,143,265 8/1964 Ruderian ..... 294/158

3,378,183 4/1968 Ferrer ..... 294/158

4,717,147 1/1988 Rochelle ..... 294/1.1

*Primary Examiner*—James B. Marbert

*Attorney, Agent, or Firm*—Larson and Taylor

[57] ABSTRACT

A carrier for helmets of the type having at least one protective ear portion with a side opening therein comprising an elongated rod having a diameter less than the diameter of said side opening, a base plate fixed to one end of said rod, said base plate having a transverse dimension larger than said side opening, a handle having a width less than the diameter of said side opening pivotably mounted at the other end of said rod and shaped so as to envelop said rod when pivoted into alignment therewith.

7 Claims, 1 Drawing Sheet

HELMET CARRIER

BACKGROUND OF THE INVENTION

This invention relates to a portable carrier for helmets commonly used in various sports.

It is now a requirement that the participants in certain organized sports such as baseball, softball, hockey, football, lacrosse and the like wear protective helmets. This safety rule has been adopted by the various professional leagues as well as amateur and semi-professional organizations. While the form and design of the helmets varies, most have at least one protective ear section that is provided with a side opening therethrough for hearing purposes. Most of such helmets include protective sections for both ears and each section has the side openings in alignment with each other. Inasmuch as games are frequently played at many different parks, the packing and transportation of a team's numerous helmets has often posed considerable problems. It has been customary in the past to gather all of the helmets after a game and haphazardly store them in a duffle bag or similar container. Carrying means of this type, previously provided for this purpose, have not been entirely satisfactory since their bulk and weight do not facilitate transportation. Also, the size and weight of many such carriers make them unfit to be carried by small children who are players in many of the leagues.

Another shortcoming of the helmet carrier resides in the fact that they often are unable to store the helmets in a fashion that permits easy access when they are to be used. Consequently, it is not uncommon to find that helmets have been lost or misplaced when stored and carried using prior art carrying means.

Lastly, the prior art carriers are often abusive to the helmets tending to reduce their useful life.

It is thus an object of the invention to provide a helmet carrier that permits easy insertion and removal of the helmets without disturbing other helmets stored.

Another object of the invention is to provide a relatively inexpensive carrier of a weight and size that render it manageable and portable by small children.

A further object of the invention is to provide a helmet carrier that permits storing or packing of numerous helmets in an orderly fashion within a relatively small space.

SUMMARY OF THE INVENTION

These and other objects of the invention are obtained by a carrier for helmets of the type having at least one protective ear portion with a side opening therein comprising an elongated rod having a diameter less than the diameter of said side opening, a base plate fixed to one end of said rod, said base plate having a transverse dimension larger than said side opening, a handle having a width less than the diameter of said side opening pivotably mounted at the other end of said rod and shaped so as to envelop said rod when pivoted into alignment therewith.

Additional advantages offered by the invention will be apparent to one skilled in the art upon consideration of the specification and the appended drawings, wherein a preferred embodiment is illustrated and wherein like numbers are used throughout to designate like parts.

DETAILED DESCRIPTION OF THE DRAWINGS

Figure 1:
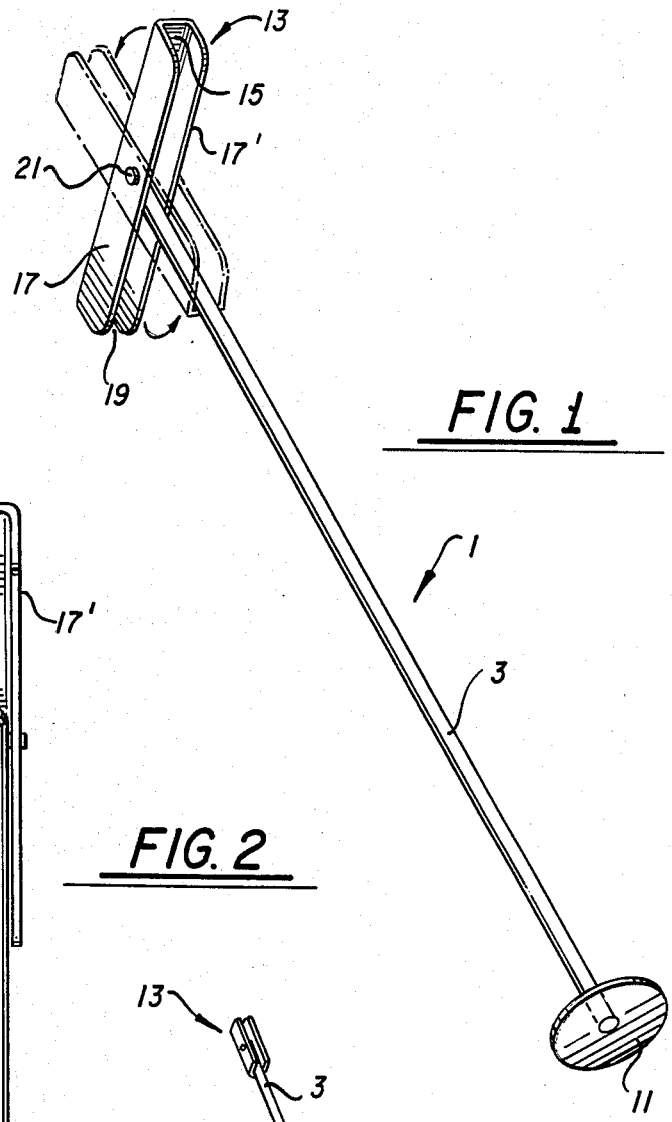
FIG. 1 is a perspective view of the helmet carrier with the handle pivoted to the loading position.

Although specific terms of the invention have been selected for illustration in the drawings and the following description is drawn in specific terms for the purpose of describing these forms of the invention, this description is not intended to limit the scope of the invention which is defined in the appended claims.

Figure 2:
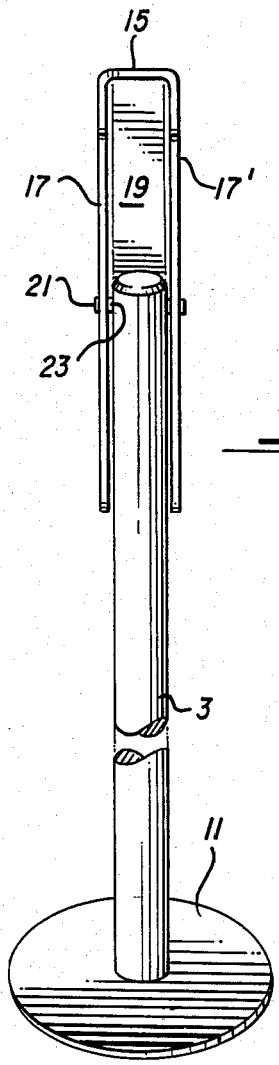
FIG. 2 is a perspective view of the helmet carrier with the handle in the carrying position.
Figure 3:
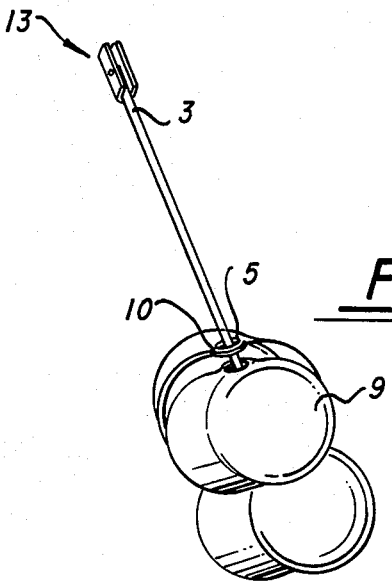
FIG. 3 is a perspective view of the helmet carrier loaded with helmets.

Referring to FIGS. 1–3, there is shown a preferred embodiment of the helmet carrier of the invention generally designated 1. The helmet carrier 1 comprises a rod 3 of any suitable rigid material such as metal, wood, plastic or the like. Rod 3 is preferably constructed of metal. As shown, the rod is cylindrical in shape but it can be any desired shape, e.g., square, triangular, rectangular, octagonal and the like, so long as a transverse dimension of the rod (the diameter in the case of a circular rod) is smaller than the side opening 5 in the protective ear section of the helmet 9. (See FIG. 3.) In a particularly preferred embodiment, the rod 3 is of a diameter just slightly smaller than opening 5 since this enables tighter storage of the helmets. The length of the rod may vary but generally ranges from about 3 to 4 feet so that it can load 8 to 10 helmets yet be transported with ease.

To one end of rod 3 is fixed a base plate 11, which is preferably flat and circular. Base plate 11 has a transverse dimension (diameter in the case of the circular base plate) larger than opening 5 of the helmet 9 so that the helmets can be loaded thereon.

The base plate 11 may be permanently or removably attached to the rod 3, and the point of attachment is preferably at substantially the center of base plate 11. Any suitable fixing means such as welding, screw means, nut and bolt means and the like can be used to attach the base plate to the rod. Alternatively, the rod 3 and base plate 11 can comprise an integral unitary structure.

At the other end of rod 3 is pivotably mounted a handle designated generally as 13. The handle is a U-shaped member having a main section 15 and side phalanges 17 and 17' integral therewith so as to define a channel 19 which receives rod 3 when the handle is pivoted to the loading position. Rod 3 is pivotably mounted to the handle 13 by means of a pin 21 which passes through hole 23 in rod 3. The ends of pin 21 are attached, as by welding, to the side phalanges 17 and 17', respectively. In a particularly preferred embodiment, the width of channel 19 is only slightly smaller than the diameter of rod 3 so that rod 3 is received therein in a relatively close fit. Also the height of the phalanges 17 and 17' should be less than the diameter of opening 5 in the protective ear flap of the helmet.

In operation, the handle is first pivoted to receive and align itself with rod 3 as shown in FIG. 1. Helmet 9 is then loaded onto the carrier by inserting the handle 13 when in loading position through the hole 5 in the protective ear flap section 10 and allowing the helmet to slip down to base plate 11 as shown in FIG. 3. When the helmets to be loaded are of the type containing two protective ear flaps with side openings in alignment with each other, a pair of helmets are first brought together so that the corresponding ear flaps of the helmets overlap each other so as to place in the alignment the holes in the ear flaps of one helmet with the holes in the ears of another helmet. The pair of helmets thus joined and aligned are then loaded by inserting the handle, pivoted in loading position, through the aligned holes and allowing the pair of helmets to drop down the rod 3. The loading procedure is then repeated until the carrier is completely loaded. Handle 15 is finally pivoted into the carrying position shown in FIG. 2 and the loaded helmet carrier is ready for transport.

As many possible combinations may be made of the invention without departing from the scope thereof, it is understood that all matter herein set forth and shown in the accompanying drawings is to be interpreted as illustrative and not in a limiting sense.

It is claimed:

1. A carrier for helmets of the type having at least one protective ear portion with a side opening therein comprising an elongated rod having a diameter less than the diameter of said side opening, a base plate fixed to one end of said rod, said base plate having a transverse dimension larger than said side opening, a handle having a width less than the diameter of said side opening pivotably mounted at the other end of said rod and shaped so as to envelop said rod when pivoted into alignment therewith.

2. A carrier according to claim 1 wherein the base plate is a flat circular plate.

3. A carrier according to claim 1 wherein the diameter of the rod is slightly smaller than the diameter of said side opening.

4. A carrier according to claim 1 wherein the handle is an elongated U-shaped member comprised of a main section and side phalanges integral therewith defining an open channel for receipt of said rod.

5. A carrier according to claim 4 wherein the width of the channel is slightly larger than the diameter of the rod.

6. A carrier according to claim 5 wherein the handle is pivotably mounted to the rod by means of a pin attached to said side phalanges.

7. A carrier for helmets of the type having at least one protective ear portion provided with a round side opening comprising an elongated rod having a diameter less than the diameter of said side opening, a flat circular base plate having a diameter larger than said side opening, a handle having a width less than the diameter of said side opening, said handle comprising an elongated U-shaped member comprised of a main section and side phalanges integral therewith defining a channel for receipt of rod when said handle is pivoted into alignment with said rod.

* * * * *